US007100847B2

(12) United States Patent
Christ et al.

(10) Patent No.: US 7,100,847 B2
(45) Date of Patent: Sep. 5, 2006

(54) FUEL INJECTION VALVE FOR INTERNAL COMBUSTION ENGINES

(75) Inventors: Wilhelm Christ, Ludwigsburg (DE); Bernd Dittus, Tamm (DE); Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/508,938

(22) PCT Filed: May 15, 2003

(86) PCT No.: PCT/DE03/01579

§ 371 (c)(1),
(2), (4) Date: Sep. 27, 2004

(87) PCT Pub. No.: WO03/098031

PCT Pub. Date: Nov. 27, 2003

(65) Prior Publication Data

US 2005/0178860 A1 Aug. 18, 2005

(30) Foreign Application Priority Data

May 18, 2002 (DE) ..... 102 22 209
Apr. 25, 2003 (DE) ..... 103 18 989

(51) Int. Cl.
*F02M 61/00* (2006.01)

(52) U.S. Cl. ..... 239/533.12; 239/533.3; 239/533.2; 239/585.1; 239/533.11; 123/467

(58) Field of Classification Search ..... 239/533.3, 239/533.9, 533.11, 533.12, 585.1–585.5; 123/467

See application file for complete search history.

(56) References Cited

U.S. PATENT DOCUMENTS 1,952,816 A * 3/1934 Mock ..... 239/488
4,721,253 A * 1/1988 Noguchi et al. ..... 239/464
4,974,565 A * 12/1990 Hashimoto et al. ..... 239/464
5,012,981 A * 5/1991 Holzgrefe et al. ..... 239/487
5,020,728 A * 6/1991 Linder et al. ..... 239/533.12
5,429,154 A * 7/1995 Kato ..... 137/625.65

* cited by examiner

*Primary Examiner*—Dinh Q. Nguyen
(74) *Attorney, Agent, or Firm*—Ronald E. Greigg

(57) ABSTRACT

A fuel injection valve with a valve body in which a valve needle that has a longitudinal axis can slide in the longitudinal direction in a bore. The combustion chamber end of the bore is provided with a conical valve seat between the valve needle and the wall of the bore a pressure chamber is formed, which can be filled with fuel and extends to the valve seat. The valve needle has a valve sealing surface that cooperates with the valve seat in order to control at least one injection opening leading from the valve seat and contains an annular groove that extends in a radial plane of the valve needle. The downstream edge of the annular groove is embodied as a sealing edge and is hydraulically connected to the pressure chamber on a continuous basis.

12 Claims, 5 Drawing Sheets

FUEL INJECTION VALVE FOR INTERNAL COMBUSTION ENGINES

CROSS-REFERENCE TO RELATED APPLICATIONS

This application is a 35 USC 371 application of PCT/DE 03/01579 filed on May 15, 2003.

BACKGROUND OF THE INVENTION

1. Field of the Invention

The invention is directed to an improved a fuel injection valve for internal combustion engines.

2. Description of the Prior Art

A fuel injection valve of the type with which this invention is concerned is known from WO 96/19661. A fuel injection valve of this kind contains a valve needle that can slide in the longitudinal direction in a bore; the combustion chamber end of the bore is provided with a conical valve seat. The valve needle is guided in a section oriented away from the combustion chamber and, between the wall of the bore and the section of the valve needle oriented toward the combustion chamber, a pressure chamber is formed, which can be filled with highly pressurized fuel. The pressure chamber here extends to the valve seat, which is conical and contains at least one injection opening. At the end oriented toward the valve seat, the valve needle has an essentially conical valve sealing surface so that when the valve sealing surface is lifted away from the valve seat, fuel can flow from the pressure chamber, between the valve seat and the valve sealing surface, and to the injection openings. The valve needle is acted upon by a closing force that presses the valve sealing surface against the valve seat and, in the absence of other forces, prevents fuel from being injected through the injection openings.

The valve sealing surface has a first conical region whose opening angle is smaller than the opening angle of the conical valve seat. Downstream of the first conical surface in the flow direction of the fuel, the valve sealing surface has another conical surface whose opening angle is greater than the opening angle of the valve seat. Between the two conical surfaces of the valve sealing surface, an annular groove is formed, which extends in a radial plane of the valve needle and borders on both conical surfaces.

In order to inject fuel into the combustion chamber of the internal combustion engine, highly pressurized fuel is conveyed into the pressure chamber of the injection valve. As a result, a valve needle pressure surface and part of the valve sealing surface are subjected to a hydraulic force that acts in opposition to the closing force. If the closing force is reduced, then the hydraulic forces move the valve needle away from the valve seat so that fuel can flow into the injection openings. The hydraulic pressure generated by the fuel pressure in the pressure chamber acts on the entire cross section of the valve needle when it is open. In order to overcome this force, the closing force must be correspondingly high since modern fuel injection systems require short closing times of the fuel injection valve in order to permit rapid sequences of precisely metered injections. As soon as the valve needle comes back into contact with the valve seat, this eliminates the hydraulic pressure on part of the valve sealing surface so that there is then a powerful excess of closing force in relation to the hydraulic force on the valve needle. This means that the valve needle is pressed against the valve seat with a large amount of force, which leads to increased wear at this point over time and can significantly reduce the service life of the fuel injection valve. Particularly in the newest fuel injection systems that operate with pressures of up to 200 MPa, the materials are being pushed to the limits of their load capacities.

SUMMARY AND ADVANTAGES OF THE INVENTION

The fuel injection valve according to the invention has the advantage over the prior art of reducing the wear on the valve seat. To this end, a hydraulic force is exerted on part of the valve sealing surface in the closed position of the valve needle, thus reducing the overall force on the valve needle in its closing direction. An annular groove between the first and second conical surface hydraulically connects the valve needle to the pressure chamber so that this annular groove always contains the same fuel pressure as the pressure chamber. When the valve needle is closed, this connection increases the hydraulically effective surface area on the valve needle and thus generates an increased force in opposition to the closing force so that the surface pressure in the region of the valve seat is reduced while simultaneously retaining favorable sealing properties.

In an advantageous embodiment of the subject of the invention, the annular groove is connected to the pressure chamber by at least one connecting bore extending inside the valve needle. Connecting bores of this kind can be produced in the valve needle by a number of different methods, preferably before the hardening of the valve needle. Another advantage is that the remaining external form of the valve needle and its mechanical stability remained practically unchanged. Embodying the connecting bores as cross bores is advantageous for the drilling process because this increases the angle of the cross bore in relation to the surfaces onto which it opens. Furthermore, the diameter of the cross bore can be enlarged up to the width of the annular groove.

In another advantageous embodiment, the annular groove is hydraulically connected to the pressure chamber by means of at least one recess provided in the first conical surface. Recesses of this kind can be let into the valve needle from the outside in a simple fashion, even after the hardening process.

In another advantageous embodiment, the seat angle difference between the second conical surface and the valve seat is less than the seat angle difference between the first conical surface and the valve seat. This design achieves an optimized distribution of the surface pressure on the valve seat and therefore reduces wear.

In another advantageous embodiment, during the closing motion of the valve needle, the sealing edge embodied at the transition from the annular groove to the second conical surface is the first part to come into contact with the valve seat. This sharp delimitation of the second conical surface and therefore of the hydraulically effective seat diameter on the valve needle when open achieves a precisely defined opening characteristic, thus permitting a precisely metered injection of fuel into the combustion chamber of the engine.

BRIEF DESCRIPTION OF THE DRAWINGS

Other features and advantages of the invention will be apparent from the description contained below, taken with the drawings, in which.

DESCRIPTION OF THE PREFERRED EMBODIMENTS

Figure 1:
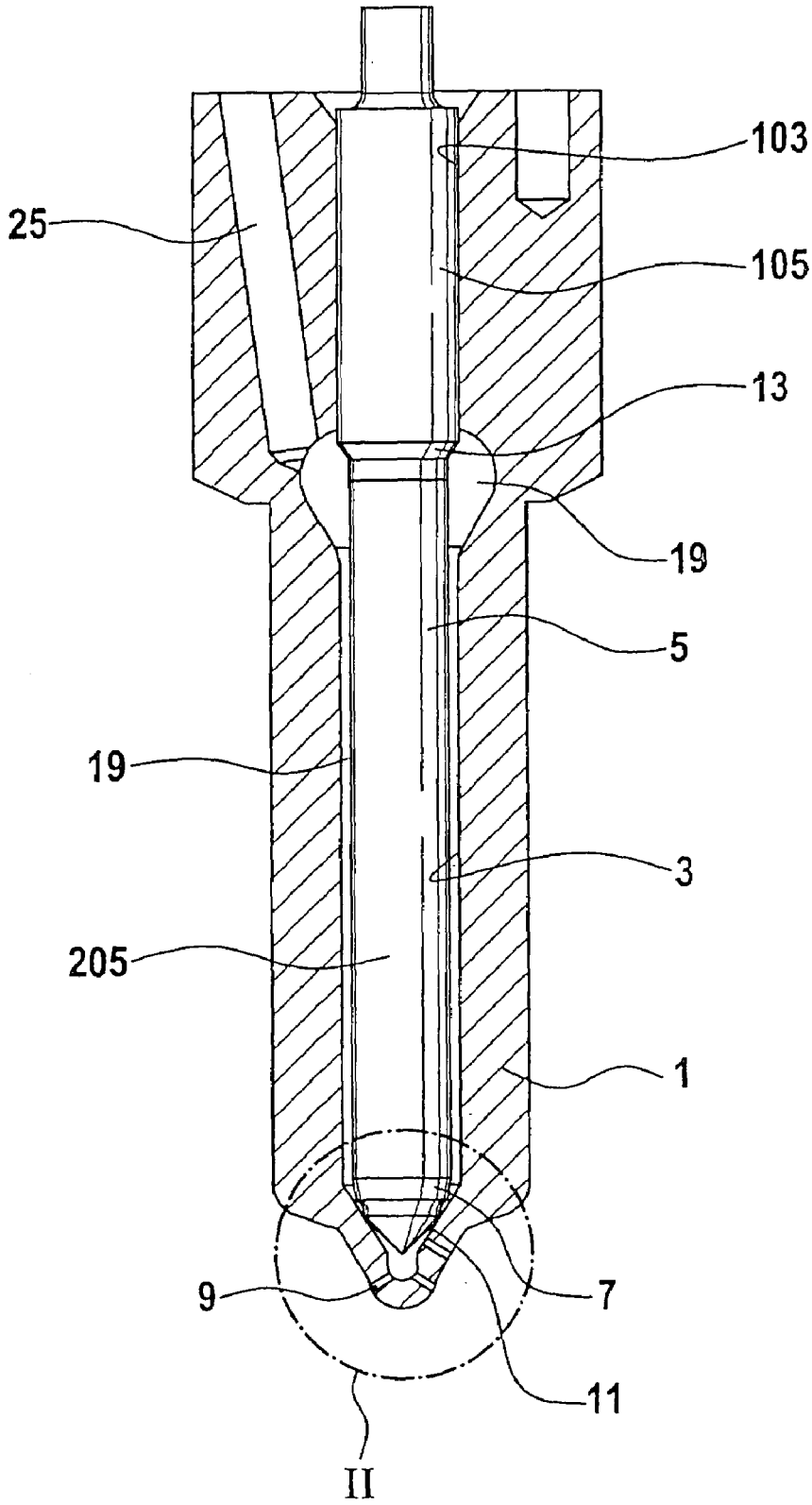
FIG. 1 shows a longitudinal section through the essential part of a fuel injection valve.

FIG. 1 shows a longitudinal section through a fuel injection valve according to the invention. A valve body 1 contains a bore 3 whose end oriented toward the combustion chamber is closed by a conical valve seat 11. The valve seat 11 is adjoined at the downstream end by a blind bore 21 (FIG. 2) that has injection openings 9 extending from it, which connect the blind bore to the combustion chamber of the engine. The bore contains a longitudinally sliding piston-shaped valve needle 5, whose guide region 105 is guided in a sealed fashion in a guide section 103 of the bore 3. Starting from the end of guide region 105 of the valve needle 5 oriented toward the valve seat 11, the valve needle 5 tapers, forming a pressure shoulder 13, and transitions into a shaft 205 that has a smaller diameter than the guide region 105. The combustion chamber end of the valve needle 5 that directly adjoins the shaft 205 is comprised of an essentially conical valve sealing surface 7, which cooperates with the valve seat 11 and whose precise form and function will be explained further below. Between the shaft 205 and the wall of the bore 3, a pressure chamber 19 is provided, in the form of an annular conduit that widens out radially at the level of the pressure shoulder 13. The pressure chamber 19 can be filled with highly pressurized fuel via a supply conduit 25 extending in the valve body 1; the supply conduit 25 feeds into the radially widened region of the pressure chamber 19.

At its end oriented away from the combustion chamber, the valve needle 5 is subjected to a closing force that is generated by a device not shown in the drawing. Known devices for this include those that generate the closing force with the aid of spring elements as well as devices that generate the closing force hydraulically. This closing force presses the valve sealing surface 7 of the valve needle 5 against the valve seat 11 so that the pressure chamber 19 is shut off from the injection openings 9, which are contained in the valve seat 11 and connect the valve seat 11 to the combustion chamber of the engine. A high fuel pressure, which can be between 100 and 200 MPa depending on the system used, prevails in the pressure chamber 19 continuously or only when an injection of fuel is to take place, depending on the injection system. In order to move the valve needle 5, either the pressure in the pressure chamber 19 is increased or the closing force on the valve needle 5 is decreased. In each case, it is necessary for the hydraulic forces acting on the pressure shoulder 13 and on part of the valve sealing surface 7 to be greater than the closing force acting on the valve needle 5. If this is the case, then the valve needle 5 moves away from the valve seat 11 so that fuel from the pressure chamber 19 can flow between the valve sealing surface 7 and the valve seat 11 to the injection openings 9. Increasing the closing force or interrupting the fuel supply into the pressure chamber 19 reverses the force ratios acting on the valve needle 5 again so that the valve needle 5 travels back toward its closed position until its valve sealing surface 7 comes into contact with the valve seat 11.

Figure 2:
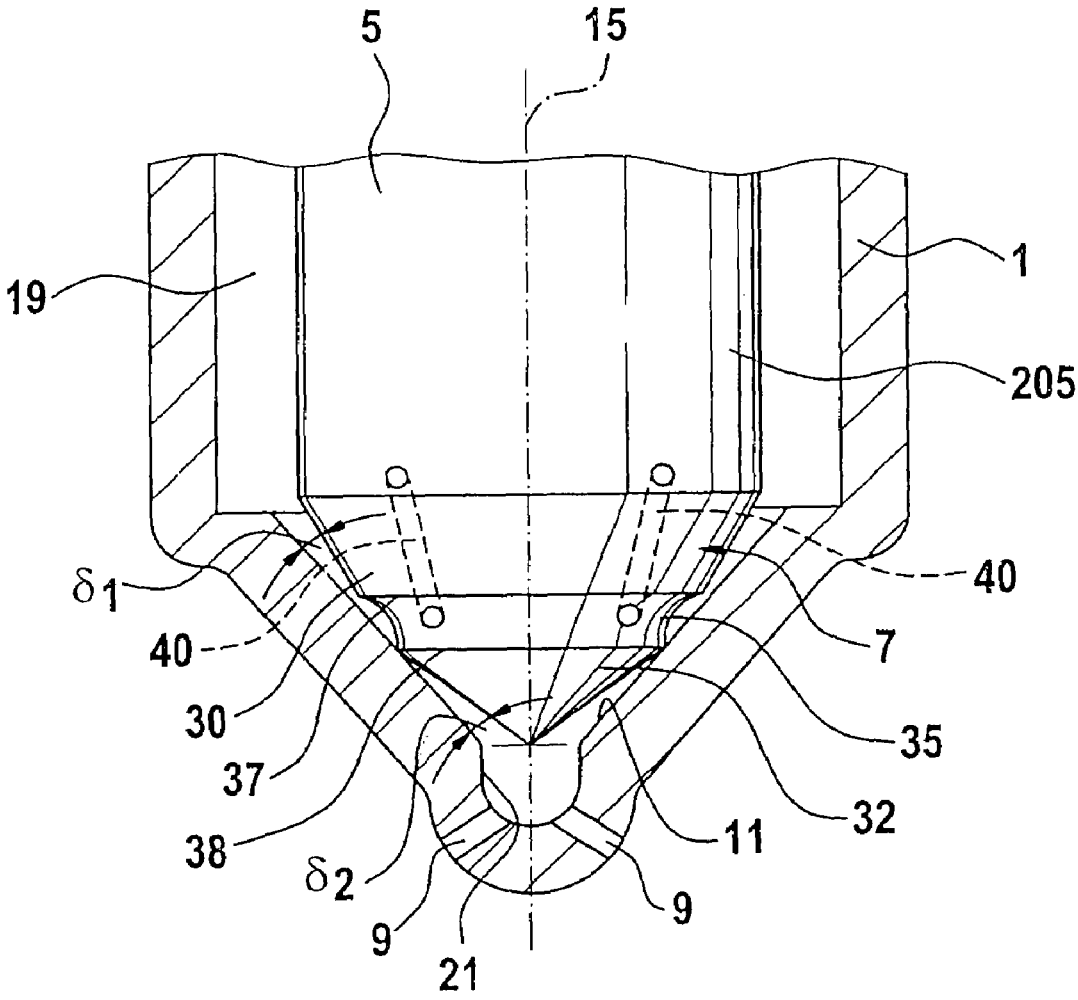
FIG. 2 shows an enlargement of FIG. 1 in the region of the valve seat; with the valve needle being shown in the position in which it is just beginning to touch the valve seat.

FIG. 2 is an enlargement of FIG. 1 in the region of the detail labeled II, i.e. in the region of the valve seat 11. The valve sealing surface 7 of the valve needle 5 has a first conical surface 30 that directly adjoins the shaft 205. The first conical surface 30 here has an opening angle that is smaller than the opening angle of the conical valve seat 11 so that a difference angle $\delta_1$ is formed between the first conical surface 30 and the valve seat 11. Downstream in the fuel flow toward the injection openings 9, the first conical surface 30 is adjoined by an annular groove 35, which encompasses the entire circumference of the valve needle 5 and extends in a radial plane of the longitudinal axis 15 of the valve needle 5. The annular groove 35 is adjoined on the downstream side by a second conical surface 32, which also constitutes the end of the valve needle 5. The opening angle of the second conical surface 32 is greater than the opening angle of the valve seat 11 so that a difference angle $\delta_2$ is formed between these two surfaces. The two conical surfaces 30, 32 and the annular groove 35 are disposed on the valve sealing surface 7 so that the circular intersecting line between the imaginary extension of the first conical surface 30 and that of the second conical surface 32 is at the level of the annular groove 35. Since the annular groove 35 is let into the valve sealing surface 7 at the end of the production process of the valve needle 5, it is therefore assured that the upper edge 37 of the annular groove 35, which constitutes the limit line of the first conical surface 30, and the sealing edge 38, which constitutes the limit line of the second conical surface 32, extend precisely in a radial plane of the longitudinal axis 15. At least two connecting bores 40 extending in the valve needle 5 connect the annular groove 35 to the pressure chamber 19. The connecting bores 40 here are preferably disposed distributed uniformly over the circumference of the valve needle 5. This consequently assures that independent of the position of the valve needle 5 in relation to the valve seat 11, the annular groove 35 contains the same fuel pressure as the pressure chamber 19 on an at least essentially continuous basis.

Figure 3:
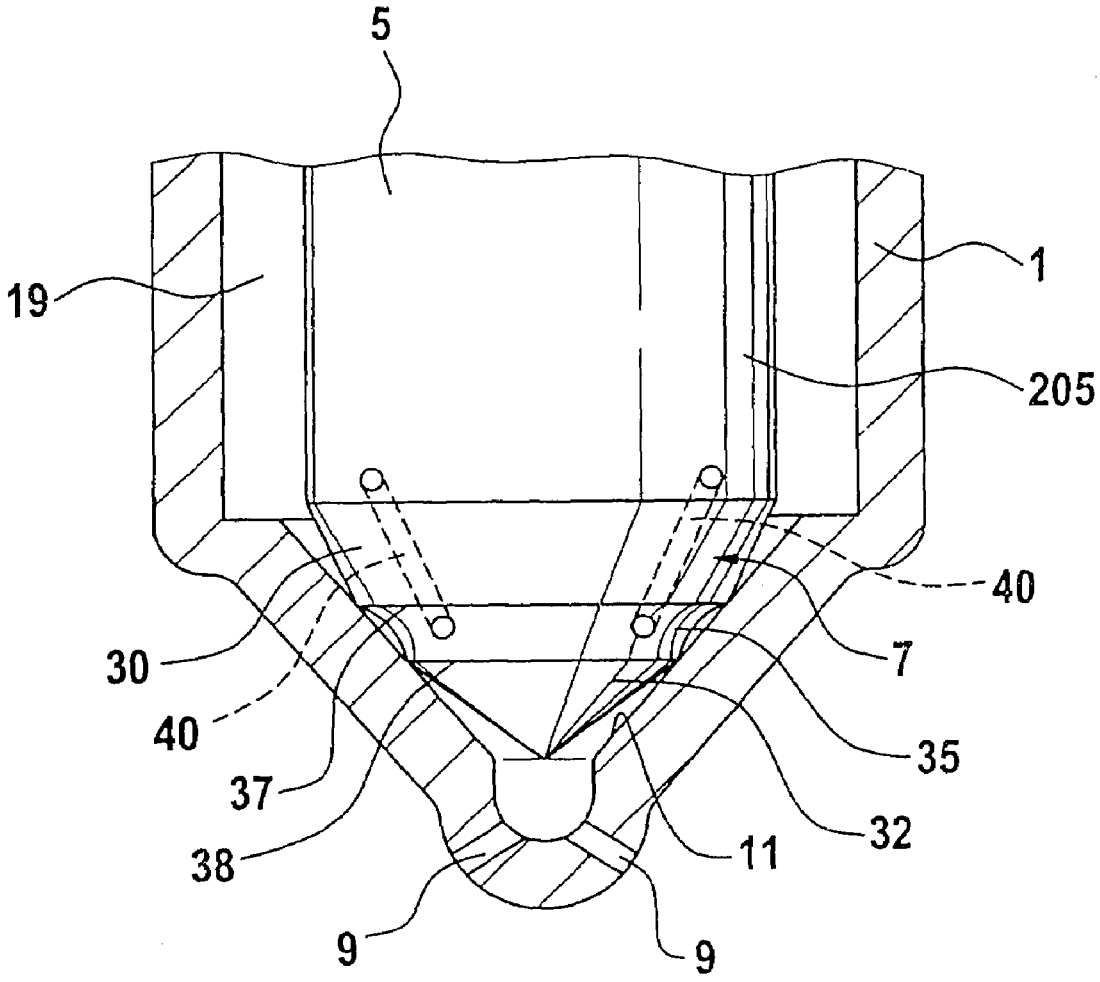
FIG. 3 shows the same detail as FIG. 2 in the closed position of the valve needle.

The opening angles of the first conical surface 30, the second conical surface 32, the valve seat 11, and the annular groove 35 allow the end of the valve needle 5 oriented toward the combustion chamber to be embodied in such a way that during the closing motion of the valve needle 5, the sealing edge 38 comes into contact with the valve seat 11 first and the downstream defining edge of the annular groove 35 does so only with continuation of the closing movement. FIG. 2 shows the valve needle 5 in precisely this position, i.e. at the moment in which the sealing edge 38 comes into contact with the valve seat 11. Without an elastic deformation of the valve needle 5 and the valve seat 11, the valve needle 5 would remain in this position. But since a powerful closing force acts on the valve needle 5, both the valve seat 11 and the valve sealing surface 7 of the valve needle 5 are deformed. The form and position of the valve needle 5 resulting from this are shown in FIG. 3. In the region of the sealing edge 38, a surface contact is produced between the valve needle 5 and the valve seat 11 as well as a high surface pressure on the valve sealing surface 7 so that in any case, a seal is produced in the region of the sealing edge 38. Due to the deformation in the region of the sealing edge 38 and the hammering of the valve needle 5 into the valve seat 11, after long-term operation in the engine, the upper edge 37 of the annular groove 35 also comes into contact with the valve seat 11. This increases the total surface area of the valve needle 5 resting against the valve seat 11 and thus reduces the surface pressure in the region of the sealing edge 38 since it is no longer receiving the full brunt of the closing force on the valve seat 11.

Figure 4:
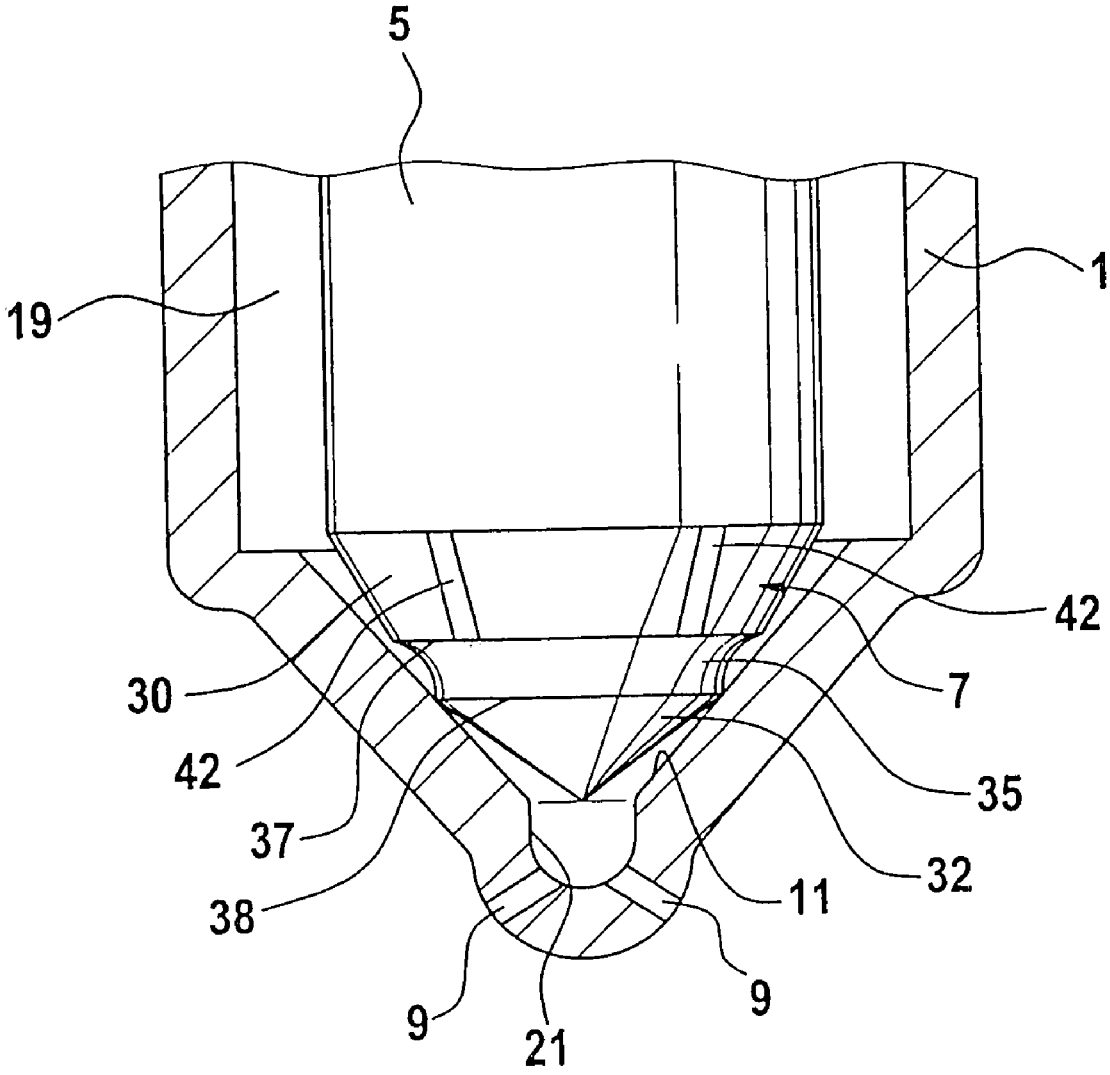
FIG. 4 shows the same detail as FIG. 2 of another exemplary embodiment

FIG. 4 shows another exemplary embodiment of the fuel injection valve according to the invention; the same detail has been selected as in FIG. 2. Instead of the connecting bores 40, at least two connecting grooves 42 are provided in the first conical surface 30 and assure that the annular groove 35 remains hydraulically connected to the pressure chamber 19. The connecting grooves 42 here are preferably disposed distributed uniformly over the circumference of the valve needle 5 and have a depth of a few tenths of a millimeter.

Figure 5:
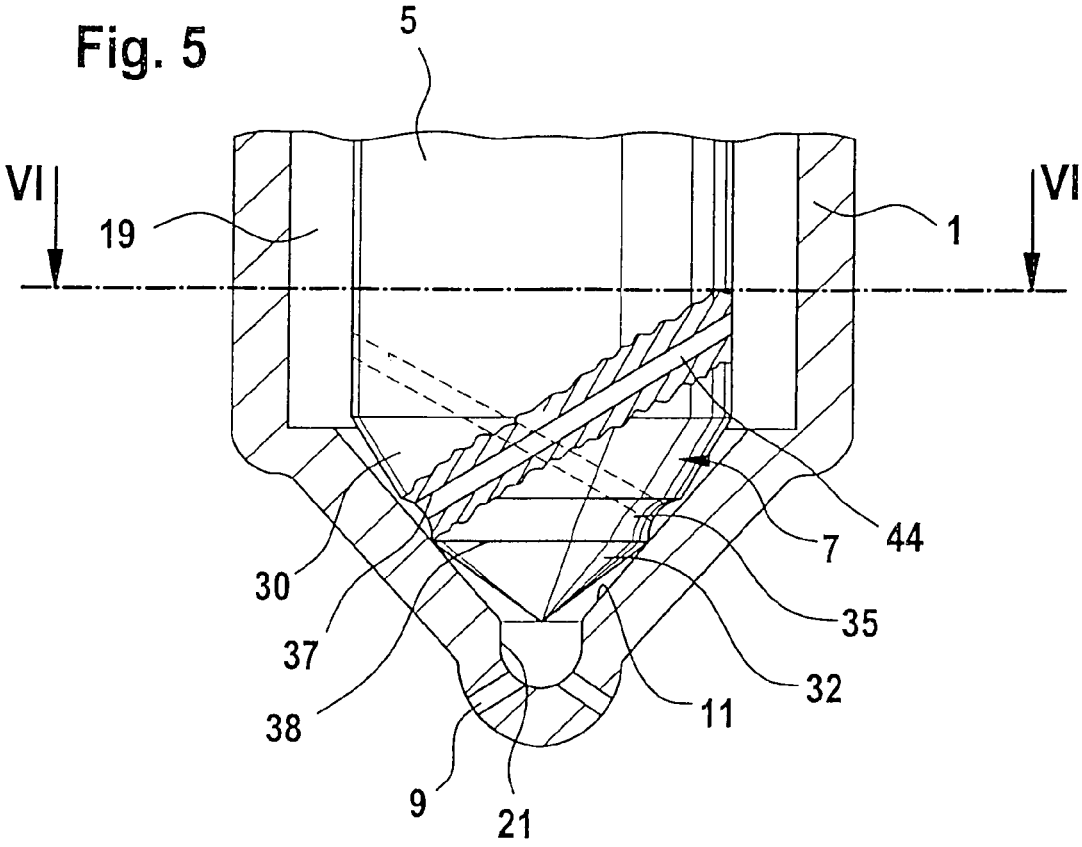
FIG. 5 shows the same detail as FIG. 2 of another exemplary embodiment.
Figure 6:
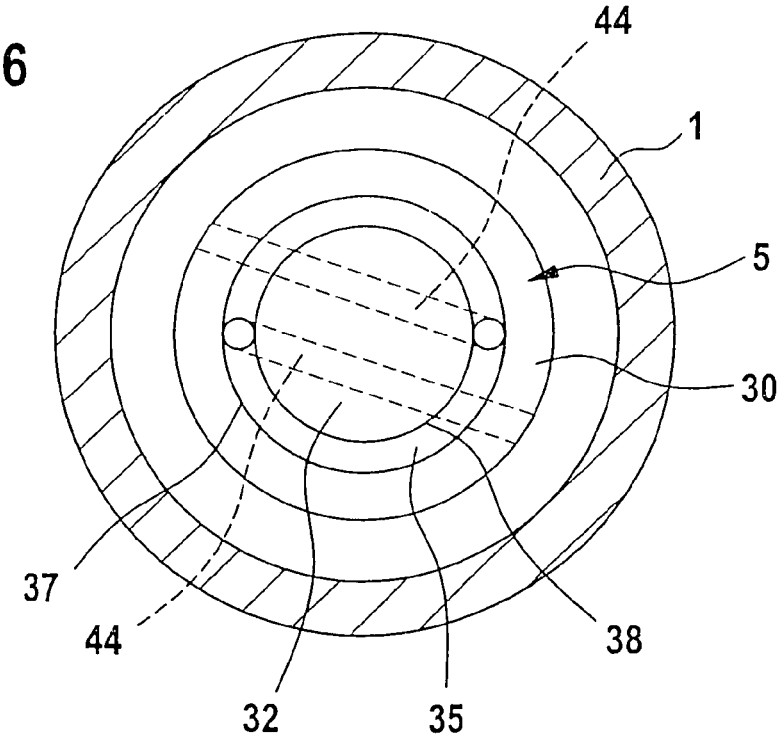
FIG. 6 shows a cross section through the fuel injection valve shown in FIG. 5, along the line VI—VI.

FIG. 5 shows another exemplary embodiment in which the annular groove 35, as in the exemplary embodiments shown in FIGS. 2 and 3, is connected to the pressure chamber by means of a connecting bore, but the connecting bore here is embodied as a cross bore 44. The cross bore 44 extends from the annular groove 35 and leads crosswise through the valve needle 5 to the surface of shaft 205. A cross bore 44 of this kind is easier to produce than a connecting bore 40 of the kind shown in FIG. 2 because in this case, there is a greater angle in relation to the surface of the valve needle 5 at both ends of the cross bore 44. FIG. 6 shows a cross section through the injection valve shown in FIG. 5, along the line VI—VI. The annular groove 35 is connected to the pressure chamber via several cross bores 44, these cross bores 44 extending parallel to each other, as shown in this projection of the plane indicated by the line VI—VI in FIG. 5. In this instance, though, the cross bores 40 are aligned so that the end of the cross bore 44 emerging from the shaft 205 is disposed as far toward the opposite side as possible from the end in the annular groove 35 without causing the cross bores 44 to intersect. The cross bore 44 here can have a diameter that corresponds to the width of the annular groove 35 or can also have a smaller diameter.

Modern fuel injection systems of the kind particularly used in autoignition internal combustion engines and in high-speed motors must currently conform to very high requirements with regard to efficiency and pollutant emissions. On the one hand, this requires injections to be carried out at a very high pressure, which can be up to 200 MPa in modern fuel injection systems. On the other hand, very short switching times of the valve needle 5 are required in order to permit rapid sequences of injections, particularly in order to produce a preinjection and secondary injection within a single injection cycle. A typical fuel injection valve for passenger vehicles that operates at a pressure of 150 MPa, for example, has a needle diameter in the guide region 105 of approximately 4 mm. When the valve needle 5 is lifted away from the valve seat 11, a force of approximately 1900 N is consequently exerted on the open valve needle 5. Particularly in systems that operate with a continuous high pressure in the pressure chamber 19, this force must be compensated for by a closing force that is considerably higher than 1900 N in order to permit a rapid closing of the valve needle 5. As soon as the valve sealing surface 7 of the valve needle 5 rests against the valve seat 11, the region of the valve sealing surface 7 disposed downstream of the sealing edge 38 is no longer subjected to the fuel pressure in the pressure chamber 19. This eliminates part of the hydraulic opening force on the valve needle 5 that counteracts the closing force so that the valve needle 5 is now pressed against the valve seat 11 with a very powerful force. Considered over the entire service life of the fuel injection valve, this high closing force and the corresponding high surface pressure on the valve seat lead to an increased wear and therefore to a premature failure of the fuel injection valve. In order to increase the hydraulic force counteracting the closing force, it would be possible to shift the sealing edge 38 further downstream, thus enlarging the partial surface of the valve sealing surface 7 acted on by the pressure in the pressure chamber 19, essentially the first conical surface 30 in the exemplary embodiment depicted. On the other hand, the closing force must have a certain minimum value so that the valve needle 5 remains closed in any case, even when there is a correspondingly high pressure in the combustion chamber between the individual injections. The fuel injection valve according to the invention solves this problem in that an additional annular groove in the valve sealing surface 7 is subjected to pressure in the pressure chamber 19, thus reducing the resulting force on the valve needle 5. At the same time, the contact of the valve needle 5 both at the sealing edge 38 and also in the region of the upper edge 37 keeps the surface pressure in the region of the sealing edge 38 low enough to avoid reaching the load capacity limit of the material.

The foregoing relates to preferred exemplary embodiments of the invention, it being understood that other variants and embodiments thereof are possible within the spirit and scope of the invention, the latter being defined by the appended claims.

The invention claimed is:

1. A fuel injection valve for internal combustion engines comprising a valve body (1) having a longitudinal bore (3) formed therein a valve needle (5) having a longitudinal axis (15) mounted for sliding movement in the longitudinal direction inside the bore (3), a conical valve seat (11) formed on the combustion chamber end of the bore (3), a pressure chamber (19) formed between a section of the valve needle (5) and the wall of the bore (3) and extending to the valve seat (11), which pressure chamber can be filled with fuel, a valve sealing surface (7) embodied on the valve needle (5), which sealing surface cooperates with the valve seat (11) in order to control at least one injection opening leading from the valve seat (11), an annular groove (35) formed in the sealing surface (7) and extending in a radial plane of the valve needle (5), the downstream edge of the annular groove (35) being embodied as a sealing edge (38), means hydraulically connecting the annular groove (35) to the pressure chamber (19) on a continuous basis, wherein the valve sealing surface (7) comprises a first conical surface (30) and a second conical surface (32) disposed downstream of the first, with the annular groove (35) extending between them, and wherein the opening angle of the first conical surface (30) is smaller than the opening angle of the conical valve seat (11) and the opening angle of the second conical surface (32) is greater than the opening angle of the conical valve seat (11).

2. The fuel injection valve according to claim 1, wherein the annular groove (35) delimits both the first conical surface (30) and the second conical surface (32).

3. The fuel injection valve according to claim 1, wherein the annular groove (35) delimits both the first conical surface (30) and the second conical surface (32).

4. The fuel injection valve according to claim 1, wherein the seat angle difference ($\delta_2$) between the second conical surface (32) and the valve seat (11) is smaller than the seat angle difference ($\delta_1$) between the first conical surface (30) and the valve seat (11).

5. The fuel injection valve according to claim 1, wherein the means providing the hydraulic connection between the annular groove (35) and the pressure chamber (19) comprises at least one connecting bore (40) extending inside the valve needle (5).

6. The fuel injection valve according to claim 5, wherein the at least one connecting bore (40) is embodied as a cross bore (44).

7. The fuel injection valve according to claim 6, wherein the at least one connecting bore (40) connects the annular groove (35) to the surface of shaft (205) of the valve needle (5).

8. The fuel injection valve according to claim 5, wherein the at least one connecting bore (40) connects the annular groove (35) to the surface of shaft (205) of the valve needle (5).

9. The fuel injection valve according to claim 1, wherein the means providing the hydraulic connection of the annular groove (35) to the pressure chamber (19) comprises at least one recess (42) provided in the first conical surface (30).

10. The fuel injection valve according to claim 1, wherein during the closing motion of the valve needle (5), the first part to come into contact with the valve seat (11) is the sealing edge (38) embodied at the transition from the annular groove (35) to the second conical surface (32).

11. The fuel injection valve according to claim 1, wherein the fuel in the pressure chamber (19), at least at certain times, has a pressure of more than 100 MPa.

12. A fuel injection valve for internal combustion engines comprising a valve body (1) having a longitudinal bore (3) formed therein a valve needle (5) having a longitudinal axis (15) mounted for sliding movement in the longitudinal direction inside the bore (3), a conical valve seat (11) formed on the combustion chamber end of the bore (3), a pressure chamber (19) formed between a section of the valve needle (5) and the wall of the bore (3) and extending to the valve seat (11), which pressure chamber can be filled with fuel, a valve sealing surface (7) embodied on the valve needle (5), which sealing surface cooperates with the valve seat (11) in order to control at least one injection opening leading from the valve seat (11), an annular groove (35) formed in the sealing surface (7) and extending in a radial plane of the valve needle (5), the downstream edge of the annular groove (35) being embodied as a sealing edge (38), means hydraulically connecting the annular groove (35) to the pressure chamber (19) on a continuous basis, wherein the valve sealing surface (7) comprises a first conical surface (30) and a second conical surface (32) disposed downstream of the first, with the annular groove (35) extending between them, and wherein in the closing motion of the valve needle (5) toward the valve seat (11), the second conical surface (32) comes into contact with the valve seat (11) first and the first conical surface (30) only comes into contact with the valve seat (11) through a deformation of the valve needle (5) and/or the valve body (1).

* * * * *